US010096311B1

(12) United States Patent
Sarkar et al.

(10) Patent No.: US 10,096,311 B1
(45) Date of Patent: Oct. 9, 2018

(54) INTELLIGENT SOUNDSCAPE ADAPTATION UTILIZING MOBILE DEVICES

(71) Applicant: Plantronics, Inc., Santa Cruz, CA (US)

(72) Inventors: Shantanu Sarkar, San Jose, CA (US); Joe Burton, Monte Sereno, CA (US); John H Hart, Saratoga, CA (US); Cary Bran, Seattle, WA (US); Philip Sherburne, Morgan Hill, CA (US)

(73) Assignee: Plantronics, Inc., Santa Cruz, CA (US)

( * ) Notice: Subject to any disclaimer, the term of this patent is extended or adjusted under 35 U.S.C. 154(b) by 0 days.

(21) Appl. No.: 15/702,625

(22) Filed: Sep. 12, 2017

(51) Int. Cl.

| | |
|---|---|
| ***H04R 3/02*** | (2006.01) |
| ***G10K 11/175*** | (2006.01) |
| ***H04R 29/00*** | (2006.01) |
| ***H04R 3/00*** | (2006.01) |
| ***H04R 1/40*** | (2006.01) |

(52) U.S. Cl.
CPC ..... *G10K 11/175* (2013.01); *H04R 1/406* (2013.01); *H04R 3/005* (2013.01); *H04R 29/002* (2013.01); *H04R 2499/11* (2013.01)

(58) Field of Classification Search
CPC .. G10K 11/175; H04R 3/005; H04R 2499/11; H04R 29/002; H04R 1/406
USPC ..... 381/73.1
See application file for complete search history.

(56) References Cited

U.S. PATENT DOCUMENTS

| | | | |
|---|---|---|---|
| 7,916,848 | B2 | 3/2011 | Rui et al. |
| 8,335,312 | B2 | 12/2012 | Gerhardt et al. |
| 8,681,203 | B1 | 3/2014 | Yin et al. |
| 9,183,845 | B1 | 11/2015 | Gopolakrishnan et al. |
| 2004/0252846 | A1 | 12/2004 | Nonaka |
| 2006/0009969 | A1 | 1/2006 | L'Esperance et al. |
| 2007/0053527 | A1 | 3/2007 | Barbieri et al. |
| 2007/0179721 | A1 | 8/2007 | Yaney |
| 2008/0159547 | A1 | 7/2008 | Schuler et al. |
| 2010/0135502 | A1 | 6/2010 | Keady et al. |
| 2010/0172510 | A1 | 7/2010 | Juvonen |
| 2011/0257967 | A1 | 10/2011 | Every et al. |
| 2011/0307253 | A1 | 12/2011 | Lloyd et al. |
| 2012/0143431 | A1 | 6/2012 | Kim et al. |

(Continued)

FOREIGN PATENT DOCUMENTS

| | | | |
|---|---|---|---|
| EP | 2755003 | A1 | 7/2014 |
| WO | WO 2011/050401 | A1 | 5/2011 |

OTHER PUBLICATIONS

Invitation to Pay Additional Fees and, Where Applicable, Protest Fee and Partial Search Report, dated Aug. 19, 2015, for International Application No. PCT/US2015/024163.

(Continued)

*Primary Examiner* — Paul S Kim
(74) *Attorney, Agent, or Firm* — Chuang Intellectual Property Law

(57) ABSTRACT

Methods and apparatuses for addressing open space noise are disclosed. In one example, a method for masking open space noise includes receiving a plurality of mobile device microphone data from a plurality of mobile devices. A location data associated with each mobile device in the plurality of mobile devices is received. A plurality of stationary microphone data is received from a plurality of stationary microphones. A sound masking noise output is adjusted at one or more loudspeakers responsive to the plurality of mobile device microphone data and the plurality of stationary microphone data.

26 Claims, 11 Drawing Sheets

(56) References Cited

U.S. PATENT DOCUMENTS

| | | | | |
|---|---|---|---|---|
| 2012/0226997 | A1 | 9/2012 | Pang | |
| 2012/0316869 | A1 | 12/2012 | Xiang et al. | |
| 2013/0030803 | A1 | 1/2013 | Liao | |
| 2013/0080018 | A1 | 3/2013 | Baek | |
| 2013/0321156 | A1 | 12/2013 | Liu | |
| 2014/0072143 | A1 | 3/2014 | Liu et al. | |
| 2014/0247319 | A1 | 9/2014 | Anderson et al. | |
| 2014/0324434 | A1 | 10/2014 | Vozila et al. | |
| 2015/0002611 | A1 | 1/2015 | Thapliyal et al. | |
| 2015/0156598 | A1 | 6/2015 | Sun et al. | |
| 2015/0179186 | A1 | 6/2015 | Swierk et al. | |
| 2015/0181332 | A1 | 6/2015 | Benway et al. | |
| 2015/0243297 | A1 | 8/2015 | Benway et al. | |
| 2015/0287421 | A1* | 10/2015 | Benway ..... | H04K 3/43<br>704/226 |

OTHER PUBLICATIONS

International Search Report and Written Opinion of the International Searching Authority dated Oct. 27, 2015, for International Application No. PCT/US2015/024163.

Elsbach et al., "It's More than a Desk: Working Smarter Through Leveraged Office Design," California Management Review 49(2):80-101, Winter 2007.

Unknown, "Gensler 2013 U.S. Workplace Survey/Key Findings," Gensler, Jul. 15, 2013, found at URL <http://www.gensler.com/uploads/documents/2013_US_Workplace_Survey_07_15_2013.pdf>.

* cited by examiner

Mobile Device Data 20

| 602 Unique Identifier | 604 Model | 606 Type | 608 Ambient Microphones | 610 Noise Level (dB) | 612 Location | 614 Correlated Stationary Microphone(s) | 616 Update Interval (sec) | 618 Weight (%) |
|---|---|---|---|---|---|---|---|---|
| Unique ID 1 | V5200 | Headset | 3 | Noise Level 1 | Location 1 | D5 | 10 | 70 |
| Unique ID 2 | B700 | Headset | 2 | Noise Level 2 | Location 2 | C2 | 120 | 25 |
| Unique ID 3 | A22 | Smartphone | 0 | Noise Level 3 | Location 3 | B5 | 60 | 50 |
| Unique ID 4 | B300 | Headset | 2 | Noise Level 4 | Location 4 | None | None | N/A |
| . | | . | . | . | . | . | . | . |
| . | | . | . | . | . | . | . | . |

FIG. 6

INTELLIGENT SOUNDSCAPE ADAPTATION UTILIZING MOBILE DEVICES

BACKGROUND OF THE INVENTION

Noise within an open space is problematic for people working within the open space. Open space noise is typically described by workers as unpleasant and uncomfortable. Speech noise, printer noise, telephone ringer noise, and other distracting sounds increase discomfort. This discomfort can be measured using subjective questionnaires as well as objective measures, such as cortisol levels.

For example, many office buildings utilize a large open office area in which many employees work in cubicles with low cubicle walls or at workstations without any acoustical barriers. Open space noise, and in particular speech noise, is the top complaint of office workers about their offices. One reason for this is that speech enters readily into the brain's working memory and is therefore highly distracting. Even speech at very low levels can be highly distracting when ambient noise levels are low (as in the case of someone having a conversation in a library). Productivity losses due to speech noise have been shown in peer-reviewed laboratory studies to be as high as 41%.

Another major issue with open offices relates to speech privacy. Workers in open offices often feel that their telephone calls or in-person conversations can be overheard. Speech privacy correlates directly to intelligibility. Lack of speech privacy creates measurable increases in stress and dissatisfaction among workers.

In the prior art, noise-absorbing ceiling tiles, carpeting, screens, and furniture have been used to decrease office noise levels. Reducing the noise levels does not, however, directly solve the problems associated with the intelligibility of speech. Speech intelligibility can be unaffected, or even increased, by these noise reduction measures. As office densification accelerates, problems caused by open space noise become accentuated.

As a result, improved methods and apparatuses for addressing open space noise are needed.

BRIEF DESCRIPTION OF THE DRAWINGS

The present invention will be readily understood by the following detailed description in conjunction with the accompanying drawings, wherein like reference numerals designate like structural elements.

FIG. 6 illustrates mobile device data in one example.

DESCRIPTION OF SPECIFIC EMBODIMENTS

Figure 1:
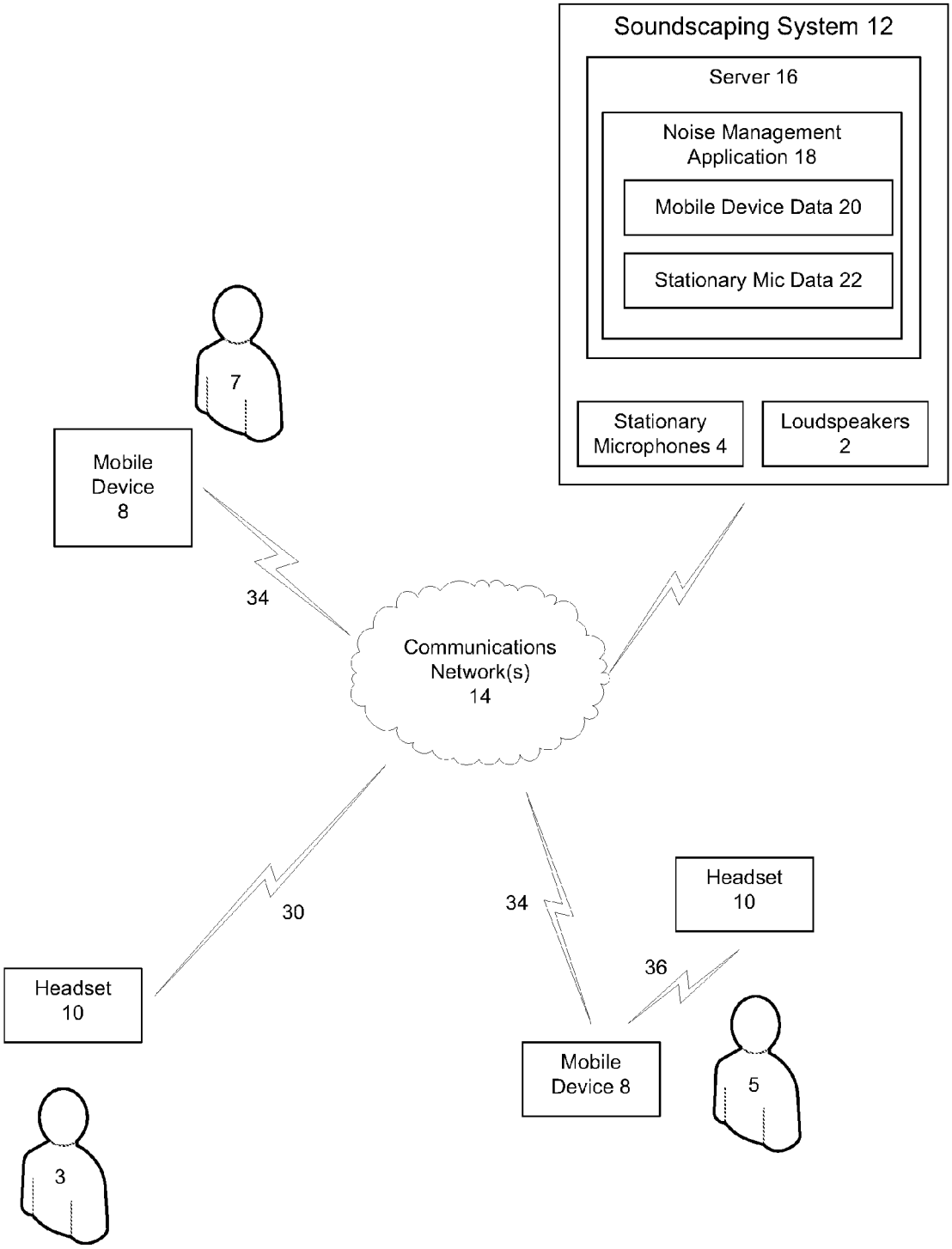
FIG. 1 illustrates a system for sound masking in one example.

Methods and apparatuses for masking open space noise are disclosed. The following description is presented to enable any person skilled in the art to make and use the invention. Descriptions of specific embodiments and applications are provided only as examples and various modifications will be readily apparent to those skilled in the art. The general principles defined herein may be applied to other embodiments and applications without departing from the spirit and scope of the invention. Thus, the present invention is to be accorded the widest scope encompassing numerous alternatives, modifications and equivalents consistent with the principles and features disclosed herein.

Block diagrams of example systems are illustrated and described for purposes of explanation. The functionality that is described as being performed by a single system component may be performed by multiple components. Similarly, a single component may be configured to perform functionality that is described as being performed by multiple components. For purpose of clarity, details relating to technical material that is known in the technical fields related to the invention have not been described in detail so as not to unnecessarily obscure the present invention. It is to be understood that various examples of the invention, although different, are not necessarily mutually exclusive. Thus, a particular feature, characteristic, or structure described in one example embodiment may be included within other embodiments.

Sound masking (also referred to as noise masking) is the introduction of a sound masking noise (also referred to as noise masking sound) in a space in order to reduce speech intelligibility, increase speech privacy, and increase acoustical comfort. For example, the sound masking noise is a background noise such as a pink noise, filtered pink noise, brown noise, or other similar noise (herein referred to simply as "pink noise") injected into the open office. Pink noise is effective in reducing speech intelligibility, increasing speech privacy, and increasing acoustical comfort. In a further example, the sound masking noise may be a natural sound, such as the sound of flowing water.

The inventors have recognized one problem in designing an optimal sound masking system is setting the proper masking levels and spectra. In certain systems, sound masking levels and spectra are set during installation. The levels and spectra are set equally on all loudspeakers. The problem with this is that office noise levels fluctuate over time and by location, and different masking levels and spectra may be required for different areas. An acoustical consultant installing a sound masking system outside of normal business hours is unlikely to properly address this problem and the masking levels and spectra may therefore be sub-optimal.

In one example of the invention, a method includes receiving a mobile microphone data from a mobile device and receiving a location data associated with the mobile device. The method includes receiving a stationary microphone data from a stationary microphone. The method includes correlating the mobile device microphone to the stationary microphone utilizing the location data. The method further includes adjusting a sound masking noise output at a loudspeaker responsive to the mobile microphone data and the stationary microphone data received from a correlated mobile microphone and stationary microphone.

In one example, a method for controlling output of sound masking noise in an open space includes receiving a plurality of mobile device microphone data from a plurality of mobile device microphones at a plurality of mobile devices. A plurality of location data is received, including receiving a location data associated with each mobile device in the plurality of mobile devices. A plurality of stationary microphone data is received from a plurality of stationary microphones. A sound masking noise output is adjusted at one or more loudspeakers responsive to the plurality of mobile device microphone data and the plurality of stationary microphone data.

In one example, a system includes a mobile device having a mobile device microphone. The system includes a plurality of stationary loudspeakers and a plurality of stationary microphones. The system includes one or more computing devices, which include one or more processors, and one or more memories storing one or more application programs executable by the one or more processors. The one or more application programs include instructions to receive a mobile device microphone data from the mobile device and receive a stationary microphone data from the plurality of stationary microphones, and adjust a sound masking volume level output at one or more of the plurality of stationary loudspeakers.

In one example, a method includes receiving a plurality of headset microphone data from a plurality of headset microphones at a plurality of headsets located in a building open space. A plurality of location data is received, including a location data associated with each headset in the plurality of headsets. A plurality of ceiling microphone data is received from a plurality of ceiling microphones disposed in a ceiling area of the building open space. A sound masking noise output is adjusted at one or more loudspeakers responsive to the plurality of headset microphone data and the plurality of ceiling microphone data.

In one example, a method includes receiving a plurality of mobile microphone data from at a plurality of mobile device microphones at a plurality of mobile devices. In one example, the plurality of mobile devices includes a plurality of wireless headsets or smartphones. A plurality of location data is received, including receiving a location data associated with each mobile device of the plurality of mobile devices. A plurality of stationary microphone data is received from a plurality of stationary microphones. In one example, the method further includes assigning a weight factor to the stationary microphone data. In one example, the plurality of stationary microphones is disposed in a ceiling area of a building open space. A mobile device microphone is correlated to a stationary microphone utilizing the plurality of location data. A sound masking noise output is adjusted at a loudspeaker responsive to data from a correlated mobile device microphone and stationary microphone.

In one example, apparatuses and methods for an adaptive soundscaping system are presented. Microphones provide real-time input on noise levels so the audio levels and frequencies at the soundscaping speakers are adjusted accordingly. Advantageously, microphone input from both ceiling microphones and user mobile device microphones is provided. The inventors have recognized that using ceiling microphones alone is not an optimal solution because the sound detected by ceiling microphones is not the same that is heard by users at ear level. As such, using the input of ceiling microphones alone is not optimal for tuning the transmit audio (i.e., sound masking noise) output from the soundscaping speakers.

Microphones in users' headsets provide input to the soundscaping system. Since the microphones are already located at ear level, they are optimally positioned to provide the valuable information for the soundscaping system. Because the headsets are worn on the user ear, the sound detected at the headset microphone most directly corresponds to what the wearer is currently hearing. Certain headsets include both microphones intended to catch what the wearer is saying and other microphones which capture background sound to perform transmit noise reduction. This second set of microphones may be referred to as ambient sound microphones. In one example, these ambient sound microphones provide the input to the soundscaping system. The characteristics of the ambient sound that are reported may include volume, frequency distribution and other factors that are utilized by the soundscaping system. The use of ambient sound microphones to provide input to the soundscaping system is particularly advantageous because they are arranged and configured at the headset to detect noise external to the headset in the vicinity of the headset wearer.

Headsets report or advertise their presence and capabilities to the soundscaping system, including whether a headset has ambient microphones and its location so that the soundscaping system can correlate the data from headset microphones to the appropriate ceiling microphones. For a WiFi headset, the headset itself performs the updates and initial signaling. For a Bluetooth or Universal Serial Bus (USB) headset, an application on a device such as a smartphone or computer is used as a signaling proxy.

The headset (either directly or through a proxy) advertises its location, capability and willingness to provide updates at a particular interval. The headset's current location can be determined by triangulating the nearest WiFi Access Points, coupling with a Bluetooth low energy (BLE) beacon location, or other location mechanisms. For a Bluetooth or USB headset, a smartphone or personal computer (PC) computes the location based on inputs from its WiFi chipset and headset information (such as BLE beacons, if available). It is also possible that the headset/proxy simply provides the raw data and a separate server computes the location based on that information. The advertisement may be an initial broadcast or multicast advertisement, with a response from the soundscaping system (e.g., a soundscaping server), after which all further communication is unicast.

The advertised capabilities depend on the type of headset. One headset model or type might have three ambient sound microphones, whereas another might have none or only two. The relative capability of a microphone to accurately detect ambient sound depends on the design of the headset, and the soundscaping server may maintain a database of designs and/or model numbers from which it determines how to weigh the inputs from a particular headset. The frequency at which a headset can send updates changes depending on its battery level and other factors, and can be a factor in the weighting that the soundscaping server assigns to the headset. Headsets may choose to send updates at other times as well, for example, when there is a change in the ambient sound characteristics, the user has moved some distance from the last update, or for other reasons. The headset may have a configurable setting which only allows for scheduled updates, updates when parameters have changed, updates as frequently as possible, or some other update timing as desired.

With respect to the actual updates, the headset may send either the audio metadata (similar to the ceiling microphones) or stream the actual audio from the ambient sound microphones to the soundscaping server, which extracts the audio metadata. Which mechanism is in use depends on the amount of compute power and bandwidth available at the headset, e.g., a first headset type might choose to send audio metadata to save on Bluetooth bandwidth and battery life, but a second headset type might choose to send the audio streams directly to save on compute power.

The location is also sent afresh with each new update, or in some periodic manner, so that as the user location changes the soundscaping server can always determine which ceiling microphone to correlate the input to. There is time synchronization between the ceiling microphones and the headset microphones so that the inputs can be correlated. For example, a clock mechanism at both headset and ceiling microphones is utilized. Network Time Protocol (NTP) may be implemented.

Depending on the amount of isolation between the wearer voice main microphone and the ambient noise microphones, the headset may choose not to send any updates when the wearer is actually speaking if the design considerations of the particular headset do not provide a high degree of confidence that the input from the ambient sound microphones is not impacted by the wearer's speech.

In one example, the headset is any one of a Bluetooth, DECT, or USB headset. The soundscaping server receives data from different headsets having different capabilities. These different headsets report data having different accuracy and at different intervals. Based on the headset capability, the soundscaping server assigns a different weight to a particular headset data in determining the appropriate response. Advantageously, through the use of both headset microphones and ceiling microphones, the sound masking system is able to make more precise determinations of the intelligibility and audio characteristics of the noise sources within the open space, and tune the output from the sound masking speakers accordingly.

FIG. 1 illustrates a system for sound masking in one example. The system includes a headset 10 in proximity to a user 3, a mobile device 8 in proximity to a user 7, and a mobile device 8 and headset 10 in proximity to a user 5. The system also includes a soundscaping system 12 capable of communications with these devices via one or more communication network(s) 14. Soundscaping system 12 includes a server 16, stationary microphones 4, and loudspeakers 2.

User 5 may utilize the headset 10 with the mobile device 8 over wireless link 36 to transmit mobile device data 20 (including, but not limited to, noise level measurements) derived from sound received at headset 10. Communication network(s) 14 may include an Internet Protocol (IP) network, cellular communications network, public switched telephone network, IEEE 802.11 wireless network, Bluetooth network, or any combination thereof.

Mobile device 8 may, for example, be any mobile computing device, including without limitation a mobile phone, laptop, PDA, headset, tablet computer, or smartphone. In a further example, mobile device 8 may be any device worn on a user body, including a bracelet, wristwatch, etc. Headset 10 may, for example, be any headworn device. For example, headset 10 is a wireless Bluetooth or DECT headset. In a further example, headset 10 is a wired USB headset removably coupled to a corresponding USB port at a personal computer, where the personal computer is connected to communications network(s) 14. The wired USB headset may be carried by a user for use at different computers within an open space or building.

Mobile devices 8 are capable of communication with server 16 via communication network(s) 14 over network connections 34. Network connections 34 may be a wired connection or wireless connection. In one example, network connection 34 is a wired or wireless connection to the Internet to access server 16. For example, mobile device 8 includes a wireless transceiver to connect to an IP network via a wireless Access Point utilizing an IEEE 802.11 communications protocol. In one example, network connections 34 are wireless cellular communications links. Similarly, headset 10 at user 3 is capable of direct communications with server 16 via communication network(s) 14 over network connection 30. Headset 10 at user 3 transmits mobile device data 20 to server 16.

Server 16 includes a noise management application 18 interfacing with one or more of mobile devices 8 and headsets 10 to receive mobile device data 20 (e.g., noise level measurements) from users 3, 5, and 7. Mobile device data 20 includes any data received from a mobile device 8 or a headset 10. In one example, noise management application 18 stores mobile device data 20 received from mobile devices 8 and headsets 10. Noise management application 18 also interfaces with stationary microphones 4 to receive stationary microphone data 22.

In one example, the noise management application 18 is configured to receive mobile device data 20 from a plurality of mobile devices (e.g., mobile devices 8 and headsets 10), receive stationary microphone data 22 from the plurality of stationary microphones 4, and adjust a sound masking volume level output from the soundscaping system 12 (e.g., at one or more of the loudspeakers 2). For example, the sound masking noise is a pink noise or natural sound such as flowing water.

Figure 2:
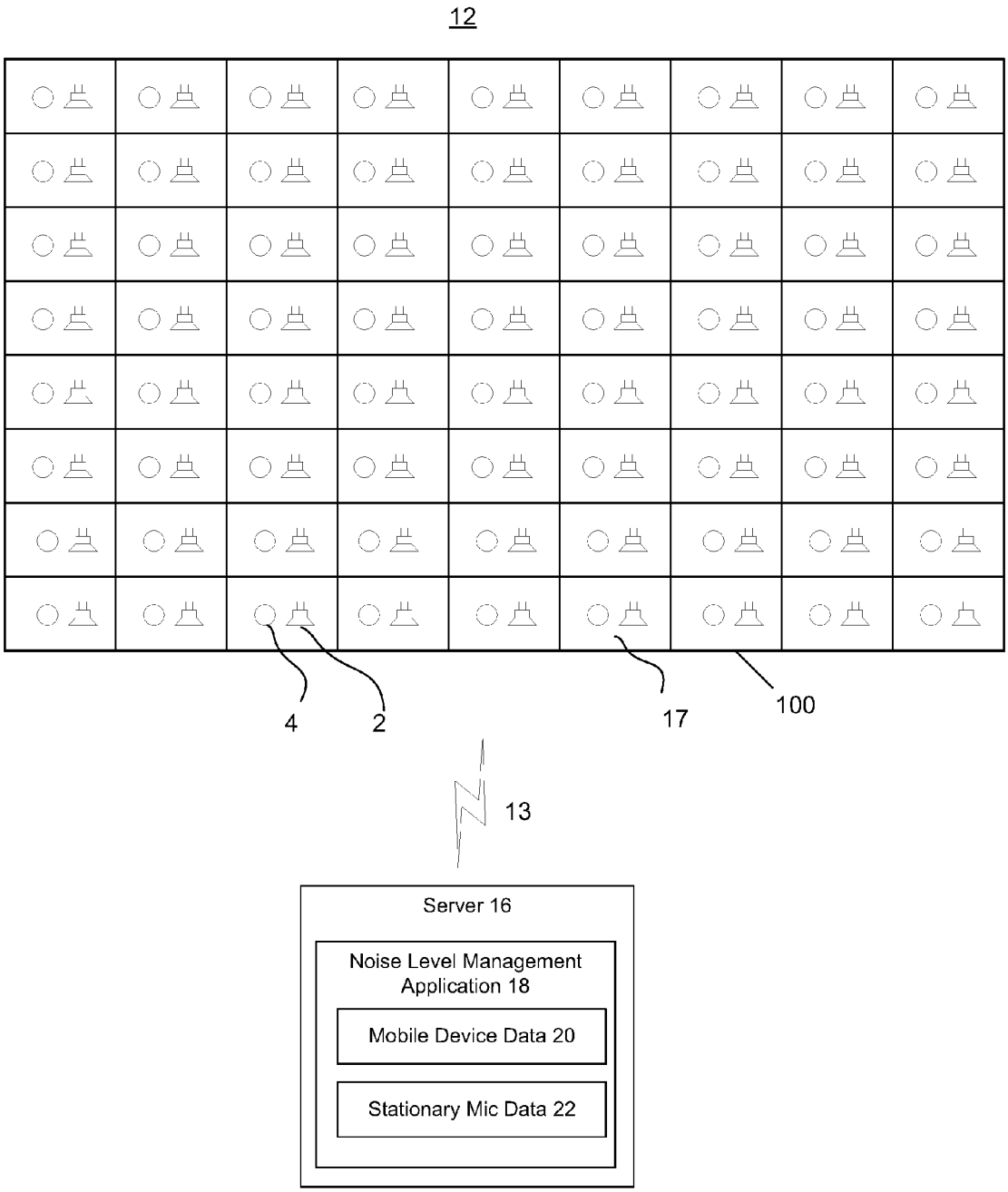
FIG. 2 illustrates an example of the soundscaping system shown in FIG. 1.

FIG. 2 illustrates an example of the soundscaping system 12 shown in FIG. 1 in one example. Placement of a plurality of loudspeakers 2 and stationary microphones 4 in an open space 100 in one example is shown. For example, open space 100 may be a large room of an office building in which employee workstations such as cubicles are placed. Illustrated in FIG. 2, there is one loudspeaker 2 for each microphone 4 located in a same geographic sub-unit 17. In further examples, the ratio of loudspeakers 2 to stationary microphones 4 may be varied. For example, there may be four loudspeakers 2 for each stationary microphone 4.

Sound masking systems may be in-plenum or direct field. In-plenum systems involve loudspeakers installed above the ceiling tiles and below the ceiling deck. The loudspeakers are generally oriented upwards, so that the masking sound reflects off of the ceiling deck, becoming diffuse. This makes it more difficult for workers to identify the source of the masking sound and thereby makes the sound less noticeable. In one example, each loudspeaker 2 is one of a plurality of loudspeakers which are disposed in a plenum above the open space and arranged to direct the loudspeaker sound in a direction opposite the open space. Stationary microphones 4 are arranged in the ceiling to detect sound in the open space. In a further example, a direct field system is used, whereby the masking sound travels directly from the loudspeakers to a listener without interacting with any reflecting or transmitting feature.

In a further example, loudspeakers 2 and stationary microphones 4 are disposed in workstation furniture located within open space 100. In one example, the loudspeakers 2 may be advantageously disposed in cubicle wall panels so that they are unobtrusive. The loudspeakers may be planar (i.e., flat panel) loudspeakers in this example to output a highly diffuse sound masking noise. Stationary microphones 4 may be also be disposed in the cubicle wall panels.

Figure 10:
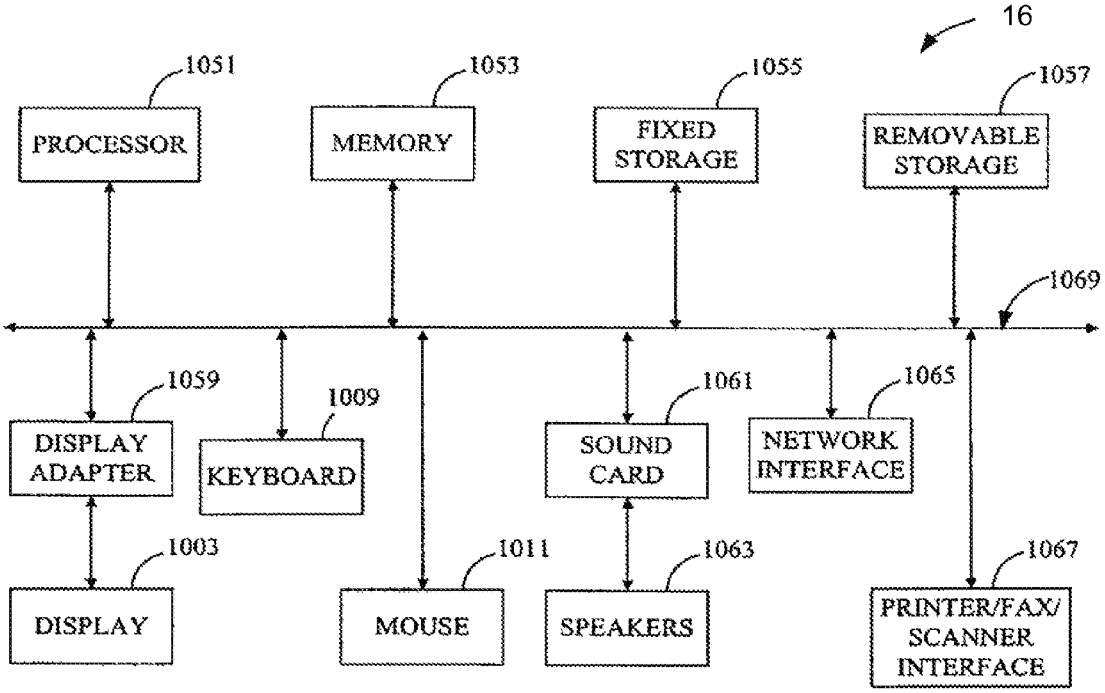
FIG. 10 illustrates a system block diagram of a server suitable for executing software application programs that implement the methods and processes described herein in one example.

The server 16 includes a processor and a memory storing application programs comprising instructions executable by the processor to perform operations as described herein to receive and process microphone signals and output sound masking signals. FIG. 10 illustrates a system block diagram of a server 16 in one example. Server 16 can be implemented at a personal computer, or in further examples, functions can be distributed across both a server device and a personal computer. For example, a personal computer may control the output at loudspeakers 2 responsive to instructions received from a server.

Server 16 includes a noise management application 18 interfacing with each stationary microphone 4 to receive microphone output signals (e.g., microphone output data.) Microphone output signals may be processed at each stationary microphone 4, at server 16, or at both. Each stationary microphone 4 transmits data to server 16. Similarly, noise management application 18 receives microphone output signals (e.g., microphone output data) from each headset 10 microphone and/or mobile device 8 microphone. Microphone output signals may be processed at each headset 10, mobile device 8, server 16, or all.

The noise management application 18 is configured to receive noise level measurements from one or more stationary microphones 4 and one or more headsets 10. In response to this headset reporting and ceiling microphone reporting, noise management application 18 makes changes to the physical environment, including increasing or reducing the volume of the sound masking at one or more loudspeakers 2 in order to maintain an optimal masking level, even as noise levels change.

In one example, the noise management application 18 is configured to receive a location data associated with each stationary microphone 4 and loudspeaker 2. In one example, each microphone 4 location and speaker 2 location within open space 100 is recorded during an installation process of the server 16. In one example, each loudspeaker 2 may serve as location beacon which may be utilized to determine the proximity of a headset 10 or mobile device 8 to the loudspeaker 2, and in turn, the location of headset 10 or mobile device 8 within open space 100.

In one example, noise management application 18 stores microphone data (i.e., mobile device data 20 and stationary microphone data 22) in one or more data structures. Microphone data may include unique identifiers for each microphone, measured noise levels or other microphone output data, and microphone location. For each microphone, the output data (e.g., measured noise level) is recorded for use by noise management application 18 as described herein. Mobile device data 20 may be stored together with stationary microphone data 22 in a single table or stored in separate tables.

Server 16 is capable of electronic communications with each loudspeaker 2 and stationary microphone 4 via either a wired or wireless communications link 13. For example, server 16, loudspeakers 2, and stationary microphones 4 are connected via one or more communications networks such as a local area network (LAN) or an Internet Protocol network. In a further example, a separate computing device may be provided for each loudspeaker 2 and stationary microphone 4 pair.

In one example, each loudspeaker 2 and stationary microphone 4 is network addressable and has a unique Internet Protocol address for individual control. Loudspeaker 2 and stationary microphone 4 may include a processor operably coupled to a network interface, output transducer, memory, amplifier, and power source. Loudspeaker 2 and stationary microphones 4 also include a wireless interface utilized to link with a control device such as server 16. In one example, the wireless interface is a Bluetooth or IEEE 802.11 transceiver. The processor allows for processing data, including receiving microphone signals and managing sound masking signals over the network interface, and may include a variety of processors (e.g., digital signal processors), with conventional CPUs being applicable.

In the system illustrated in FIG. 2, sound is output from loudspeakers 2 corresponding to a sound masking signal configured to mask open space noise. In one example, the sound masking signal is a random noise such as pink noise. The pink noise operates to mask open space noise heard by a person in open space 100. In one example, the masking levels are advantageously dynamically adjusted in response to the noise level or other measurements received from one or more stationary microphones 4 and one or more headsets 10. In one example, masking levels are adjusted on a loudspeaker-by-loudspeaker basis in order to address location-specific noise levels. Differences in the noise transmission quality at particular areas within open space 100 are taken into consideration when determining output levels of the sound masking signals.

The use of a plurality of stationary microphones 4 throughout the open space ensures complete coverage of the entire open space. The use of headset 10 microphone data allows for improved detection of speech noise (relative to the use of ceiling microphones alone) because the headsets 10 are located at head-level. Utilizing this data, noise management application 18 detects a presence of a noise source from the microphone output signals. Where the noise source is undesirable user speech, a voice activity is detected. For example, a voice activity detector (VAD) may be utilized in processing the microphone output signals. A loudness level of the noise source is determined. Other data may also be derived from the microphone output signals. In one example, a signal-to-noise ratio from the microphone output signal is identified. Since headset 10 is capable of reading noise levels at head level, it is capable of more accurately reporting noise level changes due to disruptive human speech heard by the wearer. As a result, noise management application 18 is better able to adjust the sound masking level in response to detected events. One such response is to increase or reduce the volume of the sound masking to maintain an optimal masking level as speech noise levels change.

In one example, noise management application 18 determines whether the noise source is capable of being masked with a sound masking noise from the microphone data. One or more techniques may be utilized to determine whether the noise source is capable of being masked. Noise management application 18 increases an output level of a sound masking signal at a loudspeaker 2 responsive to a determination that the noise source is capable of being masked, the loudspeaker 2 located in a same geographic sub-unit 17 of the open space 100 as the stationary microphone 4 and headset 10 microphone which detected the noise source. In one example, the volume of the sound masking noise output from the loudspeaker 2 is increased an amount responsive to a detected level of the noise source.

In one example operation, noise management application 18 receives headset 10 microphone data from a plurality of headsets 10 (i.e., mobile device data 20) located in a building open space 100. Noise management application 18 also receives a location data for each headset 10. The headset 10 microphone data and the location data are received at an adjustable time interval or responsive to a pre-defined event. For example, the headset 10 may determine whether to transmit data to server 16 based on a current battery level, whether headset wearer is currently speaking, a detected change in ambient sound characteristic, or a detected location change. Referring again to FIG. 1, headset 10 may transmit data directly to server 16 or via an intermediary mobile device 8 acting as a proxy.

The headset 10 microphone data may be any data (also referred to herein as "audio metadata) which can be derived from processing the sound detected at the headset microphone. For example, the headset 10 microphone data may include noise level measurements, frequency distribution data, or voice activity detection data determined from sound detected at the one or more headset 10 microphones. Furthermore, in addition to or in alternative to, the headset 10 microphone data may include the sound itself (e.g., a stream of digital audio data).

Figure 5:
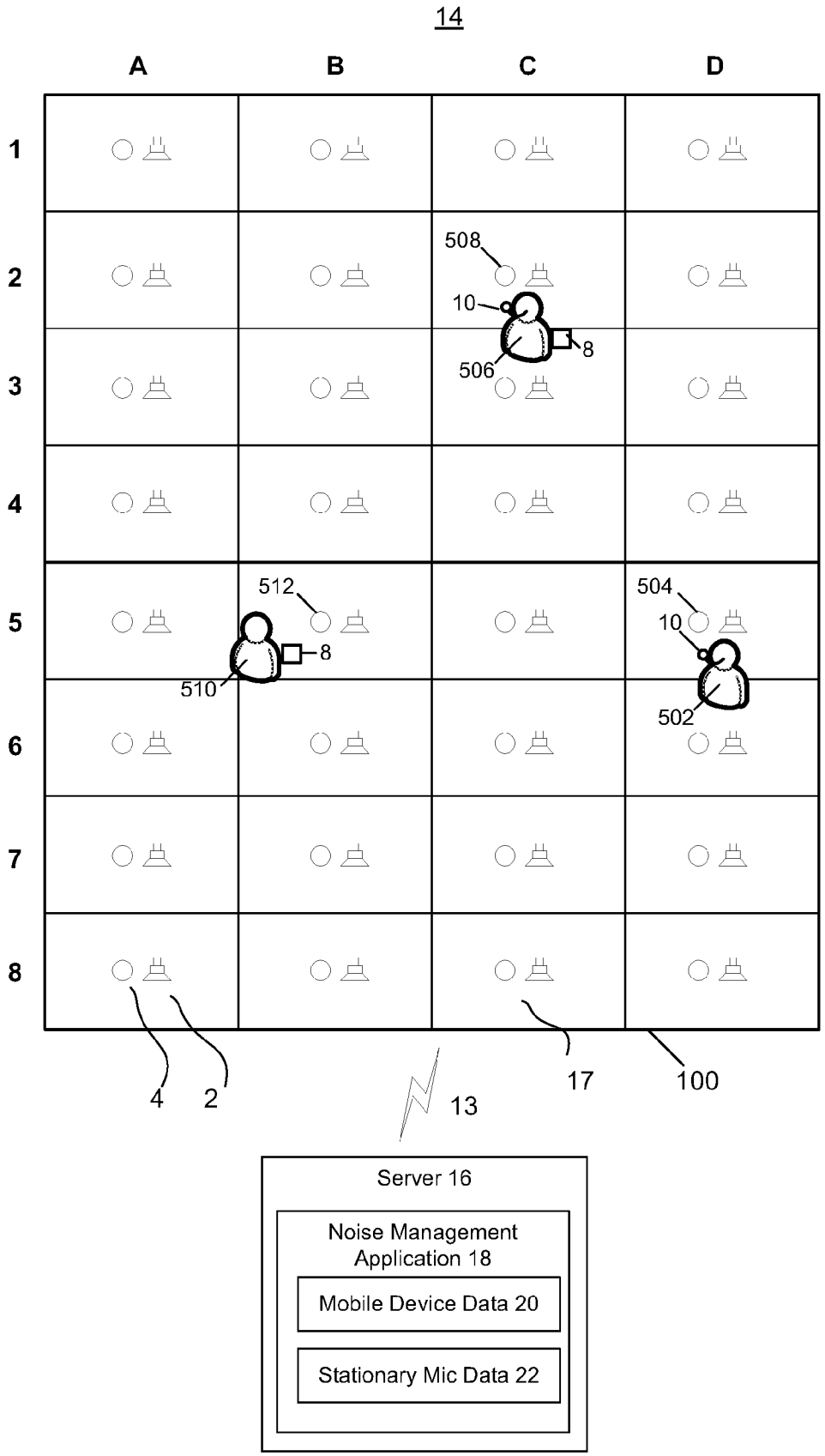
FIG. 5 illustrates correlation of headset microphones and mobile device microphones to ceiling microphones in one example of an open space.

Noise management application 18 correlates one or more headset 10 microphones to one or more stationary microphones 4 (also referred to herein as ceiling microphones 4 in a non-limiting example) utilizing the plurality of location data. For example, noise management application 18 identifies a same geographical sub-unit 17 in which one or more headset 10 microphones and one or more ceiling microphones 4 are located. The correlation is updated as the headset 10 location changes within open space 100. FIG. 5 illustrates correlation of headset 10 microphones (and mobile device microphones) to ceiling microphones 4 in one example of an open space 100. In the example shown in FIG. 5, a user 502 headset 10 is correlated to a ceiling microphone 504 at a D5 sub-unit 17. Similarly, a user 506 headset 10 is correlated to a ceiling microphone 508 at a C2 sub-unit 17. A user 510 mobile device 8 is correlated to a ceiling microphone 512 at a B5 sub-unit 17.

Noise management application 18 receives ceiling microphone data from a plurality of stationary ceiling microphones 4 disposed in a ceiling area of the building open space 100 (i.e., stationary microphone data 22). A sound masking noise output is adjusted at one or more loudspeakers 2 responsive to the plurality of headset 10 microphone data and the plurality of ceiling microphone 4 data. For example, a sound masking volume level or a sound masking noise type is adjusted.

In one example, to adjust the sound masking noise output, noise management application 18 utilizes microphone data from headset 10 microphones and ceiling microphones 4 which are correlated to each other. Noise management application 18 assigns a weight factor to a headset 10 microphone data relative to a correlated ceiling microphone 4 data.

In one example, noise management application 18 may broadcast a service advertisement requesting headsets having a capability to provide the desired headset 10 microphone data. For example, the desired headset 10 microphone data is sound detected at one or more ambient microphones. Noise management application 18 receives a communication from a headset 10 operable to identify a headset 10 capability to provide the desired headset 10 microphone data. For example, the received communication is a response to the service advertisement. The communication received from the headset may include a headset 10 identification data, such as a model number, product identification number, or unique serial number.

In one example, server 16 and a headset 10 communicate with Bluetooth low energy devices (BLE), whereby server 16 can discover and interact with headsets 10. A headset 10 broadcast advertising packets containing information about the headset's services and capabilities, including its name and functionality. For example, a headset 10 advertises it has ambient microphone data. Server 16 can scan and listen for any headset 10 that is advertising information that it is interested in and can connect to any headset 10 it has discovered advertising. After server 16 has established a connection with a headset 10, it can discover the full range of services and characteristics the headset 10 offers. Server 16 can interact with a headset's service by reading or writing the value of the service's characteristic. For example, server 16 may read ambient microphone data from the headset 10. Headset 10 may terminate advertisement of certain services during a low battery condition, such as termination that ambient microphone data is available.

Figure 3:
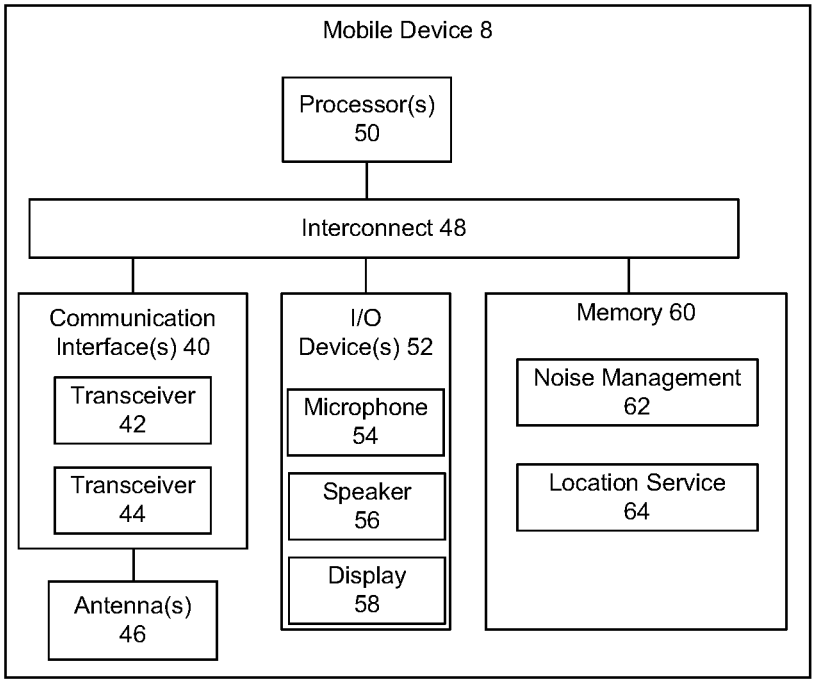
FIG. 3 illustrates a simplified block diagram of the mobile device shown in FIG. 1.
Figure 4:
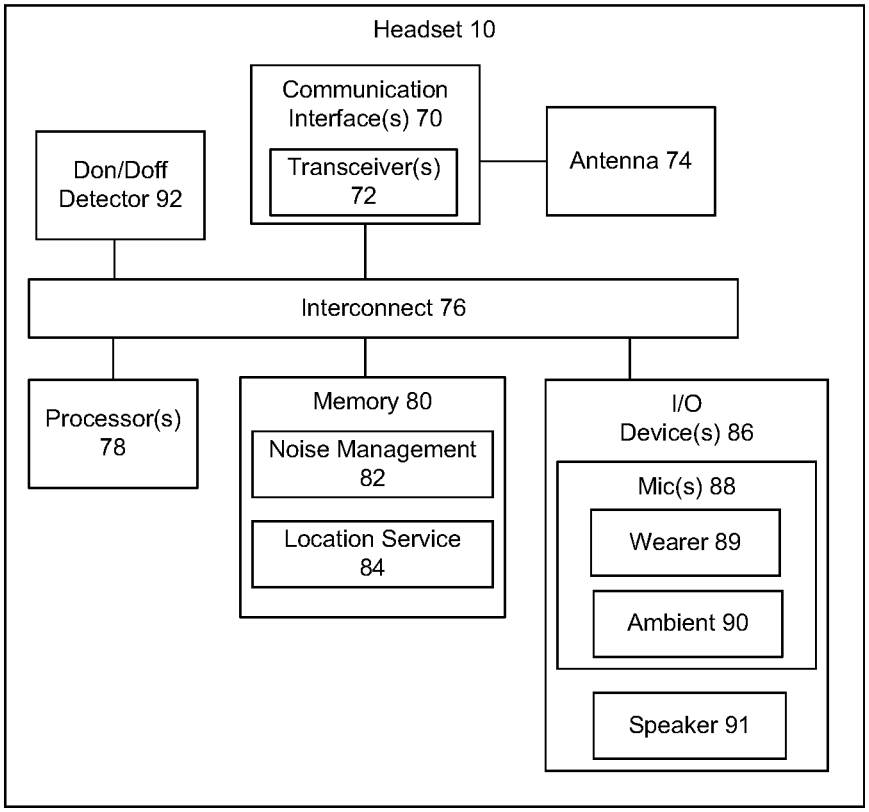
FIG. 4 illustrates a simplified block diagram of the headset shown in FIG. 1.

FIG. 3 illustrates a simplified block diagram of the mobile device 8 shown in FIG. 1. FIG. 4 illustrates a simplified block diagram of the headset 10 shown in FIG. 1. In one example, the mobile device 8 and the headset 10 each include a two-way RF communication device having data communication capabilities. The mobile device 8 and headset 10 have the capability to communicate with other computer systems via a local or wide area network.

Mobile device 8 includes input/output (I/O) device(s) 52 configured to interface with the user, including a microphone 54 operable to receive a user voice input, ambient sound, or other audio. I/O device(s) 52 include a speaker 56, and a display device 58. I/O device(s) 52 may also include additional input devices, such as a keyboard, touch screen, etc., and additional output devices. In some embodiments, I/O device(s) 52 may include one or more of a liquid crystal display (LCD), an alphanumeric input device, such as a keyboard, and/or a cursor control device.

The mobile device 8 includes a processor 50 configured to execute code stored in a memory 60. Processor 50 executes a noise management application 62 and a location service module 64 to perform functions described herein. Although shown as separate applications, noise management application 62 and location service module 64 may be integrated into a single application.

Utilizing noise management application 62, mobile device 8 is operable to receive headset 10 microphone data, including noise level measurements and speech level measurements, made at headset 10. Noise management application 62 is operable to gather mobile device 8 microphone data, including measured noise levels at mobile device 8, utilizing microphone 54.

In operation, mobile device 8 utilizes location service module 64 to determine the present location of mobile device 8 for reporting to server 16 together with mobile device 8 microphone data. In one example, mobile device 8 is a mobile device utilizing the Android operating system and the headset 10 is a wireless headset. The location service module 64 utilizes location services offered by the Android device (GPS, WiFi, and cellular network) to determine and log the location of the mobile device 8 and in turn the connected headset 10, which is deemed to have the same location as the mobile device when connected. In further examples, one or more of GPS, WiFi, or cellular network may be utilized to determine location. The GPS may be capable of determining the location of mobile device 8 to within a few inches.

While only a single processor 50 is shown, mobile device 8 may include multiple processors and/or co-processors, or one or more processors having multiple cores. The processor 50 and memory 60 may be provided on a single application-specific integrated circuit, or the processor 50 and the memory 60 may be provided in separate integrated circuits or other circuits configured to provide functionality for executing program instructions and storing program instructions and other data, respectively. Memory 60 also may be used to store temporary variables or other intermediate information during execution of instructions by processor 50.

Memory 60 may include both volatile and non-volatile memory such as random access memory (RAM) and read-only memory (ROM). Device event data for mobile device 8 and headset 10 may be stored in memory 60, including noise level measurements and other microphone-derived data and location data for mobile device 8 and/or headset 10. For example, this data may include time and date data, and location data for each noise level measurement.

Mobile device 8 includes communication interface(s) 40, one or more of which may utilize antenna(s) 46. The communications interface(s) 40 may also include other processing means, such as a digital signal processor and local oscillators. Communication interface(s) 40 include a transceiver 42 and a transceiver 44. In one example, communications interface(s) 40 include one or more short-range wireless communications subsystems which provide communication between mobile device 8 and different systems or devices. For example, transceiver 44 may be a short-range wireless communication subsystem operable to communicate with headset 10 using a personal area network or local area network. The short-range communications subsystem may include an infrared device and associated circuit components for short-range communication, a near field communications (NFC) subsystem, a Bluetooth subsystem including a transceiver, or an IEEE 802.11 (WiFi) subsystem in various non-limiting examples.

In one example, transceiver 42 is a long range wireless communications subsystem, such as a cellular communications subsystem. Transceiver 42 may provide wireless communications using, for example, Time Division, Multiple Access (TDMA) protocols, Global System for Mobile Communications (GSM) protocols, Code Division, Multiple Access (CDMA) protocols, and/or any other type of wireless communications protocol.

Interconnect 48 may communicate information between the various components of mobile device 8. Instructions may be provided to memory 60 from a storage device, such as a magnetic device, read-only memory, via a remote connection (e.g., over a network via communication interface(s) 40) that may be either wireless or wired providing access to one or more electronically accessible media. In alternative examples, hard-wired circuitry may be used in place of or in combination with software instructions, and execution of sequences of instructions is not limited to any specific combination of hardware circuitry and software instructions.

Mobile device 8 may include operating system code and specific applications code, which may be stored in non-volatile memory. For example the code may include drivers for the mobile device 8 and code for managing the drivers and a protocol stack for communicating with the communications interface(s) 40 which may include a receiver and a transmitter and is connected to antenna(s) 46. Communication interface(s) 40 provides a wireless interface for communication with headset 10.

Referring to FIG. 4, headset 10 includes communication interface(s) 70, antenna 74, memory 80, and I/O device(s) 86 substantially similar to that described above for mobile device 8. Input/output (I/O) device(s) 86 are configured to interface with the user, and include microphone(s) 88 operable to detect sound and output microphone data and a speaker 91 to output audio. Microphone 89 is positioned and configured to detect a headset wearer voice, such as at the end of the headset boom. Headset 10 includes one or more ambient microphones 90 dedicated to and optimized to detect ambient sound, which may include background noise, sounds, user voices, etc. Advantageously, ambient microphones 90 are ideally suited to monitor sound within an open space and provide input to noise management application 18 to allow for optimized sound masking output. In one example, microphones 90 are placed on the headset 10 in a position so that detection of a headset wearer voice is minimized while detection of ambient sound is maximized. For example, the ambient microphones 90 are placed on an outer side of the headset housing.

The headset 10 includes an interconnect 76 to transfer data and a processor 78 is coupled to interconnect 76 to process data. The processor 78 may execute a number of applications that control basic operations, such as data and voice communications via the communication interface(s) 70. Communication interface(s) 70 include wireless transceiver(s) 72 operable to communication with a communication interface(s) 40 at mobile device 8. The block diagrams shown for mobile device 8 and headset 10 do not necessarily show how the different component blocks are physically arranged on mobile device 8 or headset 10. For example, transceivers 42, 44, and 72 may be separated into transmitters and receivers.

The communications interface(s) 70 may also include other processing means, such as a digital signal processor and local oscillators. Communication interface(s) 70 include one or more transceiver(s) 72. In one example, communications interface(s) 70 include one or more short-range wireless communications subsystems which provide communication between headset 10 and different systems or devices. For example, transceiver(s) 72 may be a short-range wireless communication subsystem operable to communicate with mobile device 8 using a personal area network or local area network. The short-range communications subsystem may include one or more of: an infrared device and associated circuit components for short-range communication, a near field communications (NFC) subsystem, a Bluetooth subsystem including a transceiver, or an IEEE 802.11 (WiFi) subsystem in various non-limiting examples.

Headset 10 includes a don/doff detector 92 capable of detecting whether headset 10 is being worn on the user ear, including whether the user has shifted the headset from a not worn (i.e., doffed) state to a worn (i.e., donned) state. When headset 10 is properly worn, several surfaces of the headset touch or are in operable contact with the user. These touch/contact points are monitored and used to determine the donned or doffed state of the headset. In various examples, don/doff detector 92 may operate based on motion detection, temperature detection, or capacitance detection. For example, don/doff detector 92 is a capacitive sensor configured to detect whether it is in contact with user skin based on a measured capacitance. In one example, headset 10 transmits headset 10 microphone data only when it is in a donned state.

The headset 10 includes a processor 78 configured to execute code stored in a memory 80. Processor 78 executes a noise management application 82 and a location service module 84 to perform functions described herein. Although shown as separate applications, noise management application 82 and location service module 84 may be integrated into a single application.

Utilizing noise management application 82, headset 10 is operable to gather headset 10 microphone data utilizing microphone(s) 88. Noise management application 82 transmits the headset 10 microphone data to server 16 directly or via mobile device 8, depending upon the current connectivity mode of headset 10 to either communication network(s) directly via connection 30 or to mobile device 8 via link 36, as shown in FIG. 1.

In one example operation, headset 10 utilizes location service module 84 to determine the present location of headset 10 for reporting to server 16 together with the headset 10 microphone data. For example, where headset 10 connects to communication network(s) 14 via WiFi, the location service module 84 utilizes WiFi triangulation methods to determine the location of headset 10.

FIG. 6 illustrates mobile device data 20 in one example. Mobile device data 20 includes microphone data and device data received from both headsets 10 and mobile devices 8. Mobile device data 20 may be stored in a table including unique identifiers 602, model numbers 604, device type 606, number of ambient microphones 608, measured noise levels 610, locations 612, correlated stationary microphones 614, data update interval 616, and weight 618. In addition to measured noise levels 610, any gathered or measured parameter derived from microphone output data may be stored. For each user device unique identifier (e.g., a headset or mobile device serial number, user ID, MAC address), the measured noise level at the device and the location of the device is recorded for use by noise management application 18 (together with stationary microphone data 22) as described herein. Data in one or more data fields in the table may be obtained using a database and lookup mechanism. For example, the number of ambient microphones 608 may be identified by lookup-up using a unique identifier 602 or model number 604.

Figure 7:
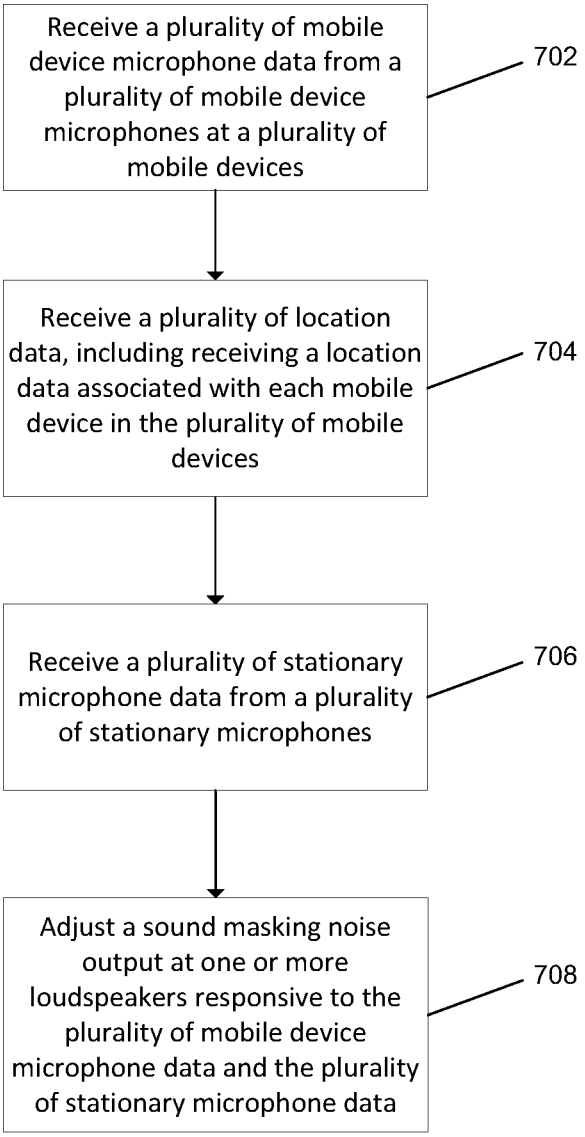
FIG. 7 is a flow diagram illustrating open space sound masking in one example.

In various embodiments, the techniques of FIGS. 7-8 discussed below may be implemented as sequences of instructions executed by one or more electronic systems. FIG. 7 is a flow diagram illustrating open space sound masking in one example. For example, the process illustrated may be implemented by the system shown in FIG. 1. At block 702, a plurality of mobile device microphone data is received from a plurality of mobile device microphones at a plurality of mobile devices. For example, the mobile devices include wireless headsets. In one example, the mobile device microphone data includes noise level measurements, frequency distribution data, or voice activity detection data derived from sound detected at the plurality of mobile device microphones. In one example, the plurality of mobile device microphone data includes the sound itself (e.g., a stream of digital audio data).

In one example, the process includes broadcasting a service advertisement requesting mobile devices having a capability to provide a desired mobile device microphone data. In one example, the process further includes receiving a communication from a mobile device operable to identify a mobile device capability to provide a desired mobile device microphone data. For example, the communication is a response to the broadcast service advertisement received at the mobile device. The communication may include a mobile device identification data, such as a model number, product identification number, or unique serial number. In one example, the desired mobile device microphone data includes data derived from output from an ambient sound microphone.

At block 704, a plurality of location data is received, including receiving a location data associated with each mobile device. In one example, the plurality of mobile device microphone data and the plurality of location data are received at an adjustable time interval or responsive to a pre-defined event. In one example, the mobile device determines whether to transmit the mobile device microphone data to the sound masking system. For example, the decision may be based on a current battery level, whether the mobile device wearer is currently speaking, a change in ambient sound characteristic, or a location change. In one example, an intermediary computing device such as a smartphone may be utilized to receive the mobile device microphone data and location data.

At block 706, a plurality of stationary microphone data is received from a plurality of stationary microphones. In one example, the plurality of stationary microphones include one more stationary microphones disposed in a ceiling area of a building open space.

At block 708, a sound masking noise output is adjusted at one or more loudspeakers responsive to the plurality of mobile device microphone data and the plurality of stationary microphone data. In one example, adjusting the sound masking noise output includes adjusting a sound masking volume level or a sound masking noise type.

In one example, one or more mobile device microphones are correlated to one or more stationary microphones utilizing the plurality of location data. The sound masking noise output is adjusted utilizing correlated mobile device microphone data and stationary microphone data. For example, correlating mobile device microphones to stationary microphones is performed by identifying a same geographical area of the building open space in which the mobile device microphones and the stationary microphones are located. The correlation is updated as the mobile device location changes.

In one example, a weight factor is assigned to a mobile device microphone data, the weight factor utilized in adjusting the sound masking noise output at the one or more loudspeakers. For example, the weight factor is used to weight the microphone data from a correlated mobile device microphone and stationary microphone in determining the response to a detected noise.

Figure 8:
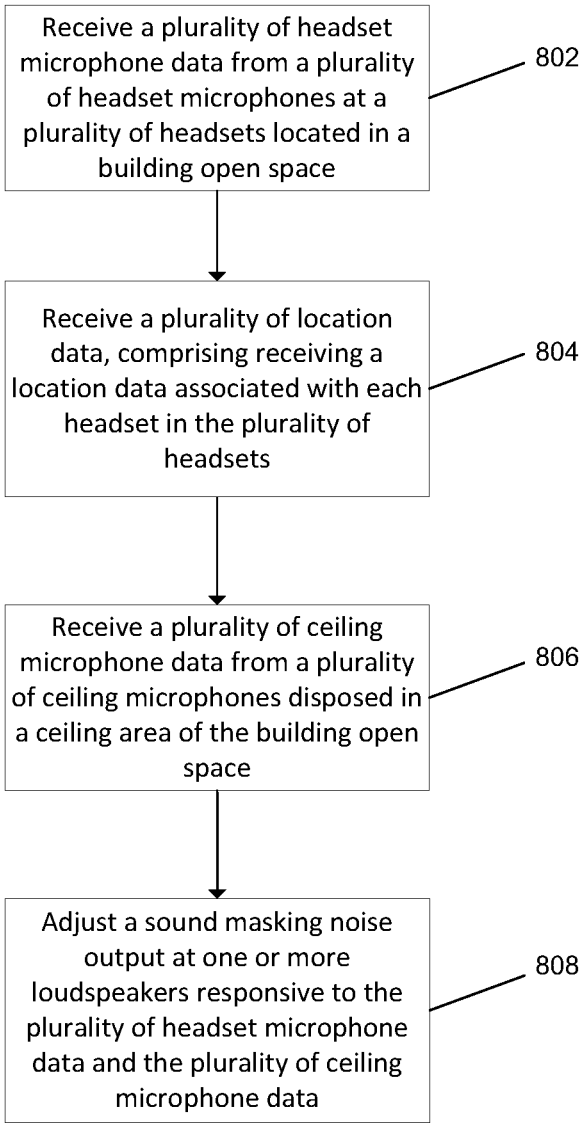
FIG. 8 is a flow diagram illustrating open space sound masking in a further example.

FIG. 8 is a flow diagram illustrating open space sound masking in a further example. For example, the process illustrated may be implemented by the system shown in FIG. 1. At block 802, a plurality of headset microphone data is received from a plurality of headset microphones at a plurality of headsets located in a building open space. In one example, the headset microphones are ambient sound microphones.

At block 804, a plurality of location data is received, including a location data associated with each headset in the plurality of headsets. At block 806, a plurality of ceiling microphone data is received from a plurality of ceiling microphones disposed in a ceiling area of the building open space.

At block 808, a sound masking noise output is adjusted at one or more loudspeakers responsive to the plurality of headset microphone data and the plurality of ceiling microphone data. In one example, one or more headset microphones are correlated to one or more ceiling microphones utilizing the plurality of location data. The sound masking noise output is adjusted at one or more loudspeakers responsive to the microphone data from one or more correlated headset microphones and ceiling microphones. For example, correlating one or more headset microphones to one or more ceiling microphones is performed by identifying a same geographical area of the building open space in which the one or more headset microphones and the one or more ceiling microphones are located.

Figure 9A:
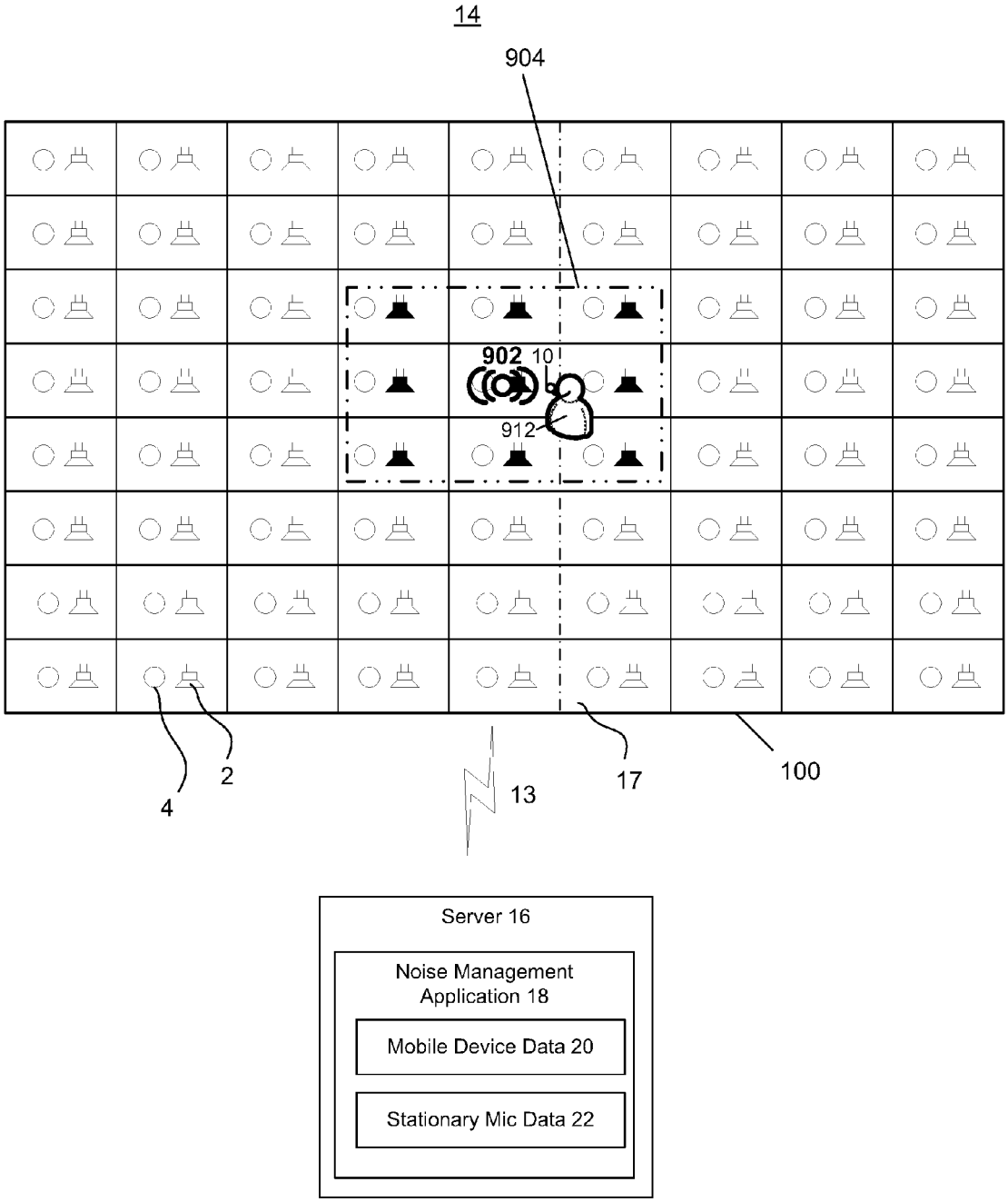
FIGS. 9A and 9B illustrate output of sound masking noise in an open space in two examples.
Figure 9B:
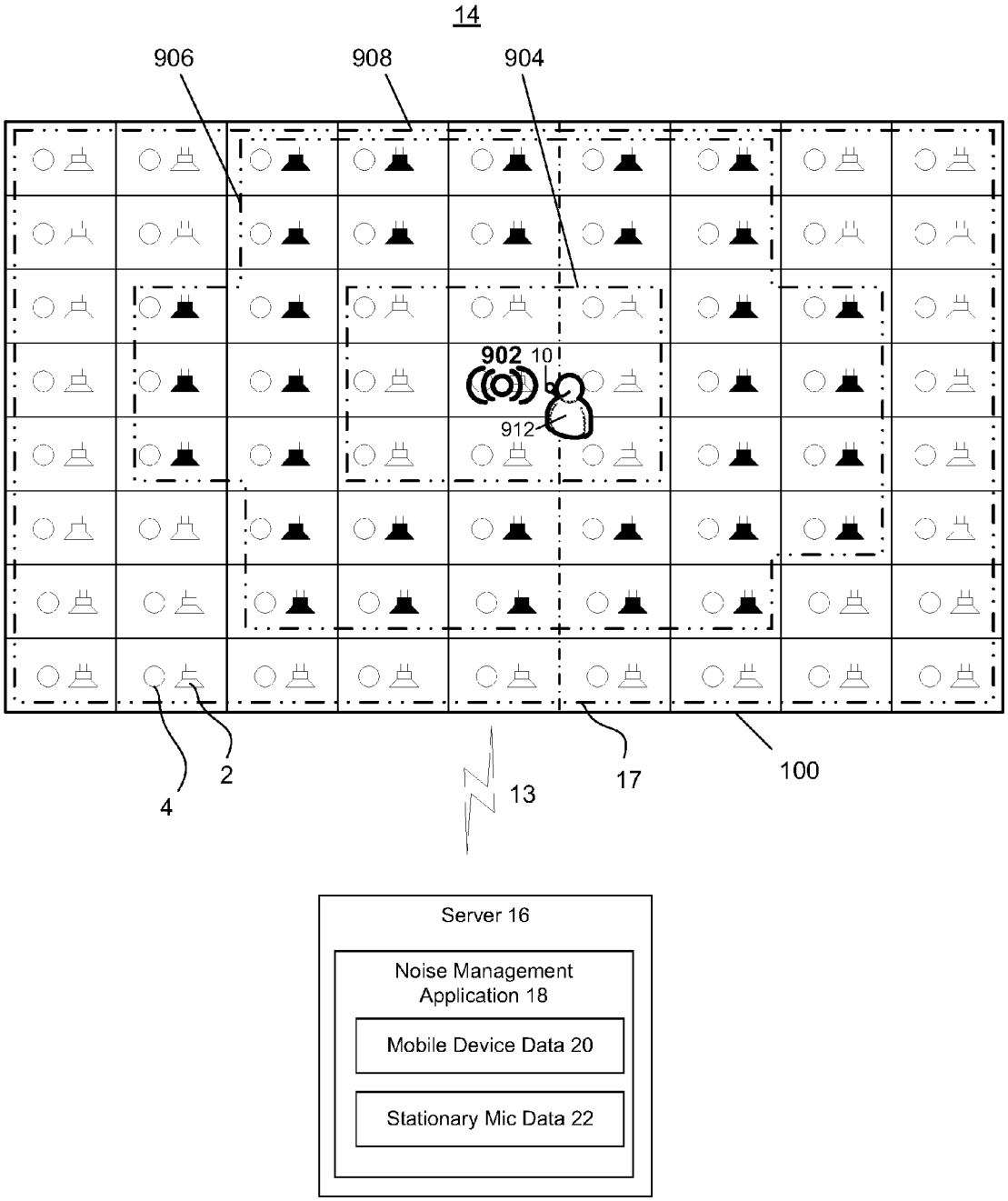

FIGS. 9A and 9B illustrate output of sound masking noise in an open space 100 in a first and second example, respectively. Noise management application 18 detects a noise source 902 in the open space 100 utilizing one or more microphones 4 and headset 10 microphones in the open space 100. Where the noise source 902 is undesirable user speech, a voice activity is detected. For example, a voice activity detector (VAD) may be utilized in processing the microphone output signals.

In response to the detection of noise source 902, noise management application 18 increases the output level of the sound masking signal at a selected group of loudspeakers 2, where the selection is dependent on the detected characteristics of noise source 902. For example the detected characteristics of noise source 902 include the detected noise level and whether there is speech. In the example shown in FIG. 9A, noise management application 18 increases the output level of the sound masking signal at all loudspeakers 2 located in region 904. In one example, noise management application 18 determines that the noise source 902 is at a level which can be masked by loudspeakers 2 located in region 904.

In one example of FIG. 9A, noise management application 18 receives all the microphone data from microphones within region 904 together with the headset 10 microphone data from user 912. The headset 10, based on its location in region 904, is assigned to region 904 and correlated to all ceiling microphones 4 in region 904. In one example, the headset 10 microphone data is designated equal weight to each of the ceiling microphones 4. In a further example, the headset 10 microphone data weight is adjusted either up or down based on the particular headset capability and update frequency of the headset. For example, a headset 10 with three ambient microphones may be designated a greater weight than a headset having only a single ambient microphone. Additional weighting factors may include whether the headset 10 is being worn and the form factor of the device from which microphone data is received. Where the headset is not being worn, a lower weight may be designated relative to a worn usage state. In a case where there are multiple headsets 10 located within region 904, these headsets are also assigned to region 904 and correlated to the ceiling microphones 4 in region 904. As a result, the input of data received from headset microphones is increased relative to the data received from ceiling microphones 4 in region 904 in determining how to adjust the sound masking output.

In the example shown in FIG. 9B, noise management application 18 determines a first region 904, a second region 906, and a third region 908 within the open space 100 responsive to detecting the noise source 902, wherein the noise source 902 is located in the first region 904, the second region 906 is outside of and adjacent to the first region 904, and the third region 908 is outside of and adjacent to the second region 906. Noise management application 18 identifies the precise location and characteristics of noise source 902 utilizing the user 912 headset 10 data and ceiling microphone 4 data.

In the first region 904, noise management application 18 maintains or reduces an output level of the sound masking signal from loudspeakers 2 located in the first region 904. In one example, noise management application 18 determines the first region 904 by identifying that the noise source 902 is at a level high enough that it cannot be masked by a sound masking signal in first region 904. In a further example, noise management application 18 determines the first region 904 by identifying a pre-determined radius from the identified location of the noise source 902.

Noise management application 18 identifies loudspeakers 2 located in the second region 906. In one example, noise management application 18 determines the second region 906 by determining whether the noise source 902 is capable of being masked with a sound masking noise. Specifically, in the second region 906, the noise source 902 is capable of being masked. One or more techniques may be utilized to determine whether the noise source 902 is capable of being masked. In one example, a signal-to-noise ratio from the microphone output signal is identified. In a further example, a loudness level of the noise source 902 is determined.

In one example, noise management application 18 increases the output level of all loudspeakers located in the second region 906 a same amount responsive to the detected level of noise source 902. In a further example, noise management application 18 adjusts a first output level of a first sound masking signal from a first loudspeaker 2 of the subset of the plurality of loudspeakers 2 located in the second region 906, and adjusts a second output level of a second sound masking signal from a second loudspeaker 2 of the subset of the plurality of loudspeakers 2 located in the second region 906. The first output level may be different from the second output level.

In the third region 908, noise management application 18 maintains an output level of the sound masking signal from the loudspeakers 2 located in the third region 908. In one example, noise management application 18 determines the third region 908 by identifying that the noise source 902 is below a detected volume level at locations within the third region 908 and a response to the noise source 902 is therefore not required.

Further discussion regarding the control of sound masking signal output at loudspeakers in response to detected noise sources can be found in the commonly assigned and co-pending U.S. patent application Ser. No. 15/615,733 entitled "Intelligent Dynamic Soundscape Adaptation", which was filed on Jun. 6, 2017, and which is hereby incorporated into this disclosure by reference.

FIG. 10 illustrates a system block diagram of a server 16 suitable for executing software application programs that implement the methods and processes described herein in one example. The architecture and configuration of the server 16 shown and described herein are merely illustrative and other computer system architectures and configurations may also be utilized.

The exemplary server 16 includes a display 1003, a keyboard 1009, and a mouse 1011, one or more drives to read a computer readable storage medium, a system memory 1053, and a hard drive 1055 which can be utilized to store and/or retrieve software programs incorporating computer codes that implement the methods and processes described herein and/or data for use with the software programs, for example. For example, the computer readable storage medium may be a CD readable by a corresponding CD-ROM or CD-RW drive 1013 or a flash memory readable by a corresponding flash memory drive. Computer readable medium typically refers to any data storage device that can store data readable by a computer system. Examples of computer readable storage media include magnetic media such as hard disks, floppy disks, and magnetic tape, optical media such as CD-ROM disks, magneto-optical media such as optical disks, and specially configured hardware devices such as application-specific integrated circuits (ASICs), programmable logic devices (PLDs), and ROM and RAM devices.

The server 16 includes various subsystems such as a microprocessor 1051 (also referred to as a CPU or central processing unit), system memory 1053, fixed storage 1055 (such as a hard drive), removable storage 1057 (such as a flash memory drive), display adapter 1059, sound card 1061, transducers 1063 (such as loudspeakers and microphones), network interface 1065, and/or printer/fax/scanner interface 1067. The server 16 also includes a system bus 1069. However, the specific buses shown are merely illustrative of any interconnection scheme serving to link the various subsystems. For example, a local bus can be utilized to connect the central processor to the system memory and display adapter. Methods and processes described herein may be executed solely upon CPU 1051 and/or may be performed across a network such as the Internet, intranet networks, or LANs (local area networks) in conjunction with a remote CPU that shares a portion of the processing.

While the exemplary embodiments of the present invention are described and illustrated herein, it will be appreciated that they are merely illustrative and that modifications can be made to these embodiments without departing from the spirit and scope of the invention. Acts described herein may be computer readable and executable instructions that can be implemented by one or more processors and stored on a computer readable memory or articles. The computer readable and executable instructions may include, for example, application programs, program modules, routines and subroutines, a thread of execution, and the like. In some instances, not all acts may be required to be implemented in a methodology described herein.

Terms such as "component", "module", and "system" are intended to encompass software, hardware, or a combination of software and hardware. For example, a system or component may be a process, a process executing on a processor, or a processor. Furthermore, a functionality, component or system may be localized on a single device or distributed across several devices. The described subject matter may be implemented as an apparatus, a method, or article of manufacture using standard programming or engineering techniques to produce software, firmware, hardware, or any combination thereof to control one or more computing devices.

Thus, the scope of the invention is intended to be defined only in terms of the following claims as may be amended, with each claim being expressly incorporated into this Description of Specific Embodiments as an embodiment of the invention.

What is claimed is:

1. A method comprising:

receiving a plurality of mobile device microphone data from a plurality of mobile device microphones at a plurality of mobile devices;

receiving a plurality of location data, comprising receiving a location data associated with each mobile device in the plurality of mobile devices;

receiving a plurality of stationary microphone data from a plurality of stationary microphones; and adjusting a sound masking noise output at one or more loudspeakers responsive to the plurality of mobile device microphone data and the plurality of stationary microphone data.

2. The method of claim 1, wherein the plurality of mobile devices comprise a plurality of wireless headsets.

3. The method of claim 1, wherein the plurality of stationary microphones comprise one more stationary microphones disposed in a ceiling area of a building open space.

4. The method of claim 1, further comprising correlating one or more mobile device microphones to one or more stationary microphones utilizing the plurality of location data.

5. The method of claim 4, wherein correlating the one or more mobile device microphones to the one or more stationary microphones utilizing the plurality of location data comprises identifying a same geographical area of the building open space in which the one or more mobile device microphones and the one or more stationary microphones are located.

6. The method of claim 1, further comprising: broadcasting a service advertisement requesting mobile devices having a capability to provide a desired mobile device microphone data.

7. The method of claim 1, further comprising: receiving a communication from a mobile device operable to identify a mobile device capability to provide a desired mobile device microphone data.

8. The method of claim 7, wherein the communication comprises a response to a service advertisement received at the mobile device.

9. The method of claim 7, wherein the communication comprises a mobile device identification data.

10. The method of claim 7, wherein the desired mobile device microphone data comprises data derived from output of a mobile device microphone dedicated to detecting ambient or background sound.

11. The method of claim 1, wherein the plurality of mobile device microphone data comprises noise level measurements, frequency distribution data, or voice activity detection data determined from sound detected at the plurality of mobile device microphones.

12. The method of claim 1, wherein the plurality of mobile device microphone data comprises sound data corresponding to sound detected at a mobile device microphone.

13. The method of claim 1, wherein the plurality of mobile device microphone data and the plurality of location data are received at an adjustable time interval or responsive to a pre-defined event.

14. The method of claim 1, wherein receiving the plurality of mobile device microphone data comprises utilizing an intermediary computing device.

15. The method of claim 1, wherein adjusting the sound masking noise output comprises adjusting a sound masking volume level or a sound masking noise type.

16. The method of claim 1, further comprising assigning a weight factor to a mobile device microphone data, the weight factor utilized in adjusting the sound masking noise output at the one or more loudspeakers.

17. The method of claim 1, further comprising: determining at a mobile device whether to transmit a mobile device microphone data to a sound masking system.

18. A method comprising:

receiving a mobile microphone data from a mobile device;

receiving a location data associated with the mobile device;

receiving a stationary microphone data from a stationary microphone;

correlating the mobile device to the stationary microphone utilizing the location data; and adjusting a sound masking noise output at a loudspeaker responsive to the mobile microphone data and the stationary microphone data received from a correlated mobile microphone and stationary microphone.

19. The method of claim 18, wherein the mobile device comprises a headset.

20. The method of claim 18, wherein the stationary microphone is disposed in a ceiling area of a building open space.

21. The method of claim 18, further comprising assigning a weight factor to the stationary microphone data, the weight factor utilizing in adjusting the sound masking noise output at the loudspeaker responsive to the mobile microphone data and the stationary microphone data.

22. A system comprising:

a mobile device comprising a mobile device microphone;

a plurality of stationary loudspeakers;

a plurality of stationary microphones; and one or more computing devices comprising:

one or more processors;

one or more memories storing one or more application programs executable by the one or more processors, the one or more application programs comprising instructions to receive a mobile device microphone data from the mobile device and receive a stationary microphone data from the plurality of stationary microphones, and adjust a sound masking volume level output at one or more of the plurality of stationary loudspeakers.

23. The system of claim 22, wherein the mobile device comprises a headset.

24. The system of claim 22, wherein the mobile device comprises a smartphone.

25. The system of claim 22, wherein the one or more application programs comprise further instructions to receive from the mobile device a location data associated with a current location of the mobile device.

26. The system of claim 25, wherein the one or more application programs comprise further instructions to correlate the mobile device microphone to a stationary microphone selected from the plurality of stationary microphones utilizing the location data.

* * * * *